United States Patent [19]

Demange et al.

[11] Patent Number: 4,616,690

[45] Date of Patent: Oct. 14, 1986

[54] PROCESS AND APPARATUS FOR MOULDING INGOTS OF FERRO-ALLOYS BY CHILL CASTING IN A COOLED COPPER MOULD

[75] Inventors: Michel Demange, LeFayet; Louis Septier, Chamonix, both of France

[73] Assignee: Societe Francaise d'Electrometallurgie-SOFREM, Paris, France

[21] Appl. No.: 653,240

[22] PCT Filed: Jan. 6, 1984

[86] PCT No.: PCT/FR84/00005

§ 371 Date: Sep. 6, 1984

§ 102(e) Date: Sep. 6, 1984

[87] PCT Pub. No.: WO84/02668

PCT Pub. Date: Jul. 19, 1984

[30] Foreign Application Priority Data

Jan. 6, 1983 [FR] France ..... 83 00474

[51] Int. Cl.[4] ..... B22D 27/04

[52] U.S. Cl. ..... 164/128; 164/271

[58] Field of Search ..... 164/47, 128, 271, 138, 164/342, 348

[56] References Cited

U.S. PATENT DOCUMENTS

| | | | |
|---|---|---|---|
| 1,588,242 | 6/1926 | Levering et al. . | |
| 1,698,836 | 1/1929 | Bartley et al. | 164/342 |
| 1,746,236 | 2/1930 | Barton . | |
| 2,197,660 | 4/1940 | Glunz et al. | 164/128 |
| 2,308,448 | 1/1943 | Hodge . | |
| 2,632,216 | 3/1953 | McQuad . | |
| 3,199,829 | 8/1965 | Calim | 164/342 |
| 3,483,916 | 12/1969 | Hard | 164/138 |
| 3,583,467 | 6/1971 | Bennent et al. | 164/128 |
| 3,903,956 | 9/1975 | Pekral | 164/138 |
| 4,298,051 | 11/1981 | Page . | |

FOREIGN PATENT DOCUMENTS

| | | | |
|---|---|---|---|
| 530822 | 10/1954 | Belgium | 164/128 |
| 1946978 | 3/1970 | Fed. Rep. of Germany . | |
| 658482 | 6/1929 | France . | |
| 1538948 | 9/1968 | France . | |
| 51-8119 | 1/1976 | Japan | 164/342 |
| 57-91839 | 6/1982 | Japan | 164/138 |
| 549553 | 11/1942 | United Kingdom . | |
| 1194588 | 6/1970 | United Kingdom . | |

*Primary Examiner*—Nicholas P. Godici
*Assistant Examiner*—G. M. Reid
*Attorney, Agent, or Firm*—Dennison, Meserole, Pollack & Scheiner

[57] ABSTRACT

The present invention concerns a process and an apparatus for moulding ingots of ferro-alloys by chill casting in a cooled copper mould.

The apparatus comprises:

an ingot mould (1) of copper, which is formed from two mould halves (2), at least one of which comprises a plurality of impressions (10) of the ingots to be moulded, communicating with each other by way of ducts (11, 12) and opening in the upper part by way of an ingate (18), means (5) for cooling each mould half (2) by a heat exchange fluid, means (9) for bringing the two mould halves into contact and into sealing relationship, means for moving the two mould halves away from each other, and means (7, 8) for guiding the mould halves in their movement away from each other and in their movement of coming into sealing relationship.

10 Claims, 5 Drawing Figures

PROCESS AND APPARATUS FOR MOULDING INGOTS OF FERRO-ALLOYS BY CHILL CASTING IN A COOLED COPPER MOULD

The present invention concerns a process and apparatus for moulding ingots of ferro-alloys by chill casting in a cooled copper mould.

When ferro-alloys are used as additive or treatment elements in ferrous alloys or metals in the molten state, they are used in the form of crushed blocks with a unit weight which may be from some tens of grams to a few kilograms. That is the case in particular with alloys based on iron and silicon, which are used as additives for example for the production of silicon killed steels and as deoxidising agents for steels in general.

It is known that, irrespective of the type of crusher used, the operation of crushing the ferro-silicon produces a relatively substantial quantity of fines (from 10 to 15% of the metal used), and the subsequent use thereof gives rise to technical and economic problems which as yet have not been fully solved. The same also applies in regard to other types of ferro-alloys.

French patent FR-A-No. 1 538 948 (corresponding to U.S. Pat. No. 3 604 494) to METALLGESELLSCHAFT A.G. and SUDDEUTSCHE KALKSTICKSTOFFWERKE A.G. proposed casting pre-alloys of the ferro-silico-magnesium type in cases made of thin sheet metal, which are previously filled to about two thirds or three quarters with crushed blocks of the same alloy or an alloy of slightly different composition, providing for very rapid cooling and thus preventing the sheet metal case from melting.

It is also known for alloys of the ferro-silico-magnesium family to be cast by sand moulding in order to produce inoculating agents for cast irons, in the form of shaped portions which are introduced into cavities in the runners (that process being referred to as "inoculation in-mould").

However, the various processes referred to above are not suited nor can they be rendered suitable to economic and massive production of blocks from an electric furnace having a continuous production per hour of several tonnes, for example a furnace for producing ferro-silicon containing 75% of Si, with an output of 16 MW, which produces about 2 T/h of alloy.

The present invention therefore concerns a process which permits the moulding of ferro-alloy blocks of a predetermined shape and weight, by casting in a cooled copper mould of the liquid metal issuing from the production furnace either directly or by being transferred by way of a ladle or any intermediate vessel.

This process is characterised by the following repetitive steps:

- an ingot mould is formed by the juxtaposition in sealed relationship of two copper mould halves, one at least of which comprises a plurality of impressions of the ingots to be moulded, said impressions communicating with each other by way of ducts and opening in the upper part of the mould by way of at least one ingate,
- a cooling circuit is established in each mould half by the circulation of a heat exchange fluid,
- the liquid ferro-alloy is poured into the ingate until the ingot mould is filled,
- the ferro-alloy is left to set and cool to a temperature which is 200° C. and preferably 300° C. below its solidus temperature, and
- the two mould halves are separated for removal of the ingots from the mould.

The invention also concerns an apparatus for carrying out the process comprising:

- an ingot mould formed of two mould halves made of copper, one at least of which comprises a plurality of impressions of the ingots to be moulded, said impressions communicating with each other by means of ducts and opening in the upper part by way of an ingate,
- means for cooling each mould half by the circulation of a heat exchange fluid,
- means for moving the mould halves towards and away from each other, and
- means for guiding the mould halves in their movements towards and away from each other.

The apparatus may also comprise cooled means for introducing the liquid ferro-alloy into the ingate.

The invention is particularly suitable for the production of moulded blocks of ferro-silicon which have a silicon content of higher than 15% and preferably between 40 and 90%, the balance being iron and, as appropriate, secondary additive elements such as Al, Ba, Ca, Mn, Ti and Zr.

FIG. 1 is a view in vertical section of an ingot mould for carrying out the invention, FIG. 2 is a view in horizontal section taken along line A—A in FIG. 1, FIG. 3 is an industrial ingot mould comprising four elements, the opening and closing movements of which are controlled by jacks, and FIGS. 4 and 5 show two alternative embodiments in which the mould halves are asymmetric.

Figure 1:
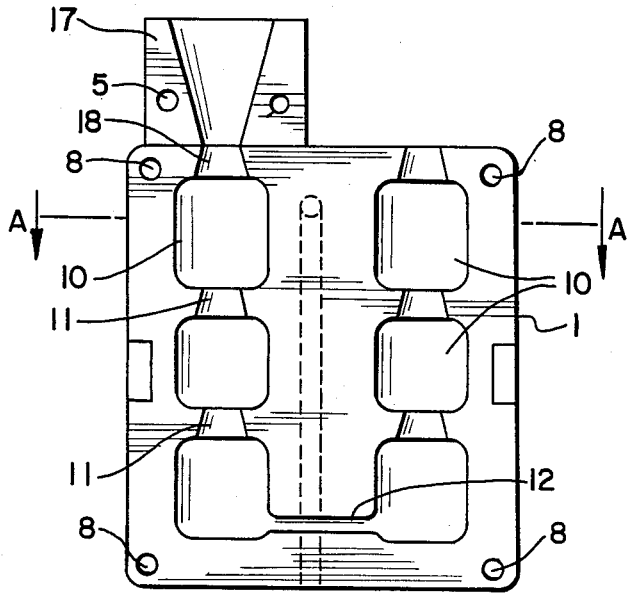
FIGS. 1 to 5 illustrate the manner of performing the invention.

Hereinafter, the term "ingot mould" will be used to denote the subject-matter of the present invention, it being appreciated that that term denotes a particular ingot mould in which the metal is introduced in a molten state and is removed in the form of multiple ingots of predetermined dimensions, shape and weight.

Each ingot mould 1 comprises two half elements or "mould halves", as indicated at 2, of electrolytic copper, preferably of the quality referred to as Cu/al (being the designation used in the French standard NF A-51.050), each mould half being provided with a cooling circuit for the circulation of a heat exchange fluid, comprising a main intake 3 which is connected to the fluid supply means, for feeding, in a parallel mode in the illustrated embodiment, three branch circuits 4A, 4B, 4C, the outlet collector manifolds of which combine at a common outlet. The cooling circuits are internal (ducts 5 drilled in the copper block forming the mould halves) but they may optionally be external (copper tubes 6 which are welded or brazed over their entire length to the outside faces of the mould halves).

Each mould half 2 further comprises sealing contact means to form the ingot mould. The mould halves may be brought into contact by for example holding one of the mould halves in a fixed position and moving the other mould half theretowards, or by moving the two mould halves towards each other, either by a guided linear translatory movement or by a rotary movement about a common axis forming a pivot means.

The linear translatory movement may be guided by any known means such as guide rods 7 which are slidable in internal calibrated apertures 8 or by external sliding means such as grooves and slide members.

The operation of bringing the mould halves into contact by a rotary movement may be performed about a vertical or a horizontal axis. In the latter case, the operation of removing the moulded ingots from the mould is facilitated by virtue of the fact that the ingots come away from the mould and drop into a receiving means, under the effect of their own weight.

The different movements of bringing the mould halves together and moving them apart are controlled in known manner by means such as the jacks 9.

Figure 2:
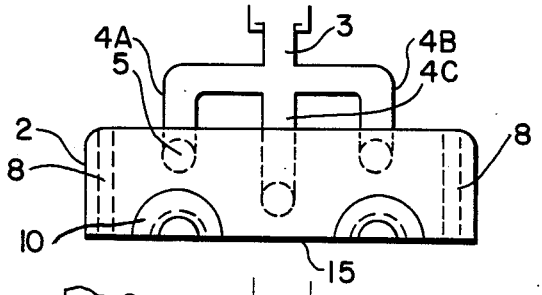
Figure 3:
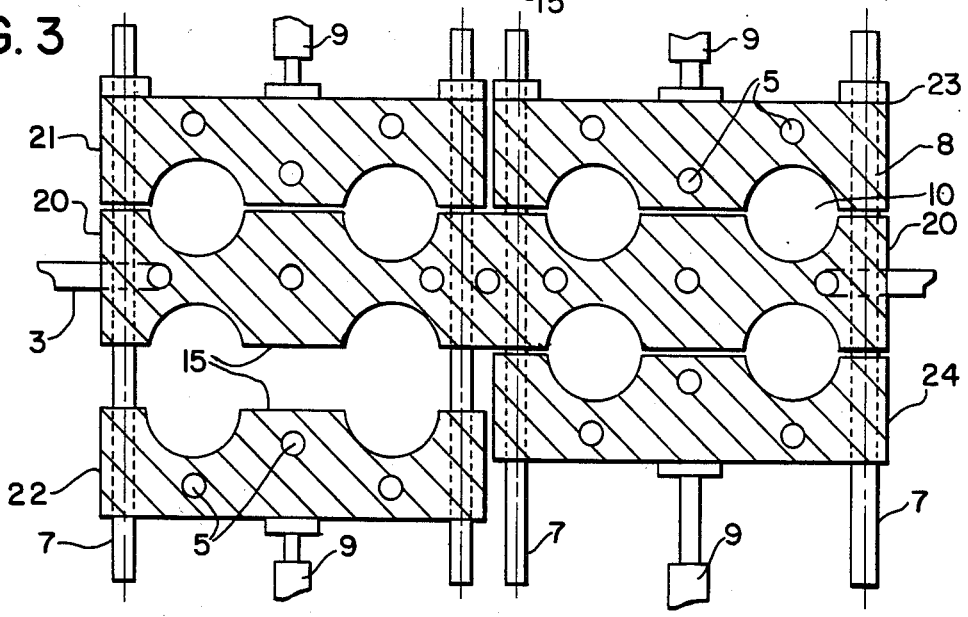
Figure 4:
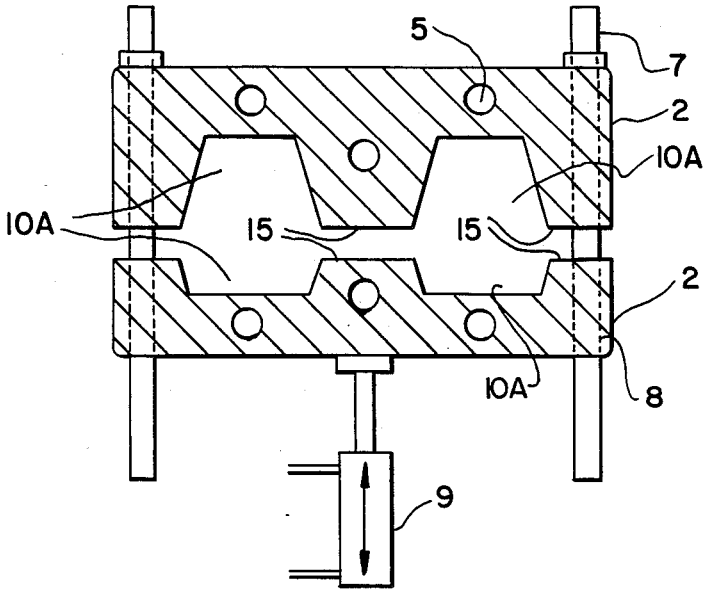
Figure 5:
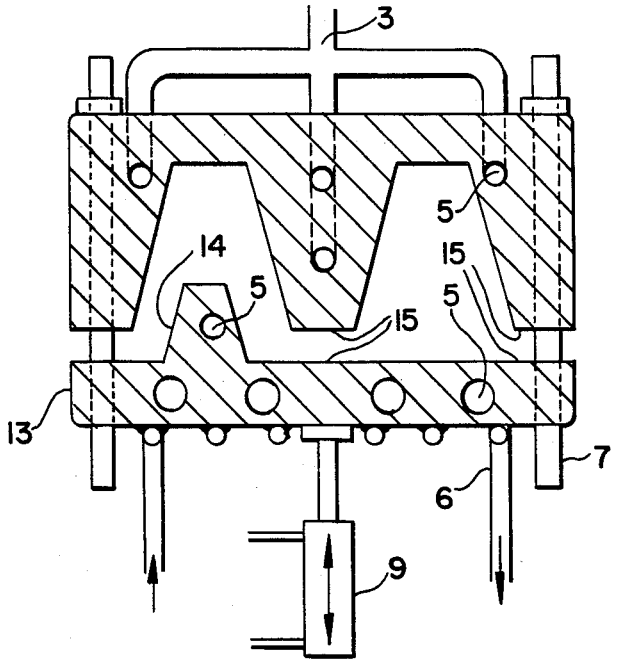

Each mould half comprises the half impressions 10 corresponding to the ingots and the connecting ducts 11 and 12. The mould halves may be symmetrical (see FIGS. 1, 2 and 3) or asymmetric, as shown at 10B and 10A (see FIGS. 4 and 5). One of them may even be reduced to a co-operating plate 13 which is flat or which is optionally provided with a raised moulding portion 14 having a cooling circuit 5 which permits an increase in the area of contact between the cast metal and the ingot mould and therefore the speed of cooling and the rate of casting.

The facing contact surfaces 15 of each mould half are trued and polished so as to ensure that a satisfactory fluid-tight seal is formed, under the effect of the jacks 9, without the interposition of any sealing member.

The operation of casting the liquid ferro-alloy in the ingot mould is preferably carried out by means of the charging funnel 17. The funnel 17 may be fixed to and integrated in the actual ingot mould or it may be removable and positioned on the pouring gate 18, the contact surfaces also being trued and polished. In both cases, the member 17 is also provided with a cooling circuit. The ducts and impressions beneath the member 17 are supplied in the top pouring mode while the others are supplied in the bottom pouring mode. The number and the dimensions of the impressions or cavities and the ducts are so determined as to ensure total filling before the metal begins to set and blocks the feed ducts or runners.

FIG. 1 shows a view in cross section of an ingot mould having 2×3 impressions or cavities, but that arrangement is given only by way of non-limiting example and it could equally well comprise 2×2 or 2×4 cavities.

The problem which had to be overcome in order to carry the invention into effect was as follows: it was necessary both to provide a fairly high casting rate in order to follow the production of a large modern furnace producing ferro-silicon or other ferro-alloy, without however thereby tying up an excessive amount of copper in the form of a large number of ingot moulds, and to ensure that the ingot moulds enjoyed a fairly long operating life so that the amortization of the cost thereof does not substantially increase the cost of the ingots produced, in relation to the cost of the ferro-silicon which is cast in the form of slabs weighing several tons, then crushed and ground. That result was achieved:

(1) by virtue of the choice of material forming the ingot moulds, the thermal conductivity of which must be as high as possible, which directs the choice towards the electrolytic copper referred to as Cu/al as defined by the French standard NF A 53.100 (thermal conductivity at 20°=400 to 412 W/mK) or the weakly alloyed copper such as "CUPRONICS" (registered trade mark of TREFIMETAUX) (365 W/mK) or CuZr 0.15, containing 0.15% of zirconium (350 to 370 W/mK), or any other copper-base alloy having a level of thermal conductivity which is at least equal to 300 W/mK;

(2) by virtue of the provision of a highly efficient cooling circuit, the heat exchange fluid being water at ambient temperature, which makes it possible at all points to avoid an increase in the temperature of the copper above 200° C. and thus to reduce to a negligible rate the increase in size of the grains of copper (recrystallisation) which is the main cause of degradation of ingot moulds;

(3) by virtue of the selected ratio:

(mass of copper forming the ingot mould)/(mass of cast ferro-alloy)

which is selected at a value at least equal to 6 and preferably between 10 and 25; and (4) by virtue of extremely rapid extraction of the ingots from the mould so that the only function of the ingot mould is to solidify at least the outside part of the ingots down to a temperature which is from 200° to 300° below the solidus point of the alloy, cooling to ambient temperature then occurring spontaneously, outside the ingot mould, over any period of time which is no longer an important factor.

EMBODIMENT

An ingot mould was made from copper Cu/al, in accordance with the invention, comprising a central fixed block 20 provided with internal water cooling circuits 5 and four mould halves 21, 22, 23 and 24 which are movable separately or simultaneously by the action of jacks 9, each mould half having its own cooling circuit. Each mould half comprises six impressions or cavities 10 which are connected by ducts 11 and 12, which are filled by means of a cooled copper feeder funnel 17. Each of the impressions or cavities 24 corresponds to an ingot weighing about 550 grams, plus the sprue portions formed by the connecting ducts or runners and the feed heads, which corresponds to about 14 kg of ferro-silicon per operation, wherein each casting cycle can be reduced to 90 seconds, then being broken down as follows:

Pouring: 15 seconds

Solidification of FeSi 75: 15 seconds

Cooling of the ingots to about 900° C. (solidus point at 1208° C.): 15 seconds

Cooling of the moulds after opening thereof and removal of the hot ingots: 30 seconds Times for opening and closing the ingot moulds and idle times: 20 seconds giving a production per hour of 15×40=600 kilos. Four such ingot moulds are therefore sufficient to mould in ingot form the total production of a ferro-silicon-75 furnace having a capacity of 2.4 T/h (~20 MW). After four months of continuous use, they are still in the normal operating condition.

The manner in which the present invention is carried into effect may be the subject of a certain number of variations, in particular as regards the following:

(1) the form of the ingot moulds which may be formed from two symmetrical mould halves or from asymmetric mould elements (see FIGS. 4 and 5), (2) the nature of the metal being cast. If the invention is particularly well suited to alloys based on iron and silicon, it may also be used without any modification to the basic principle thereof with different alloys, for example alloys based on iron and manganese, or manganese and silicon. However, the attraction of the present invention is particularly apparent in the case of metals in which crushing produces substantial amounts of fines which are difficult to use or to recycle, and (3) the shape, dimensions and unit weight of the ingots which may vary in dependence on the use envisaged, within very wide limits, it being appreciated that the form of the ingots is subordinate to the necessity for spontaneous and very quick extraction of the moulded ingots from the mould as soon as the ingot mould is opened, and that the minimum unit weight is in most cases imposed by economic factors.

We claim:

1. A process for molding ingots of ferro-alloys at a high casting rate, and extending the life of the mold material, comprising the steps of:

(a) forming an ingot mold by juxtaposing in sealed relationship two mold halves of copper of high thermal conductivity, having a thermal conductivity of at least 400 W/mK, at least one of said halves comprising a plurality of impressions of ingots to be molded, each said impression communicating with its adjacent impression in series by means of a duct, said series of impressions opening at the upper part of the ingot mold by means of at least one in-gate, and opening to the atmosphere after the final impression in series;

(b) establishing a cooling circuit in each mold half by circulation of a heat exchange fluid sufficient to maintain the high thermal conductivity copper of the ingot mold at all points at a temperature which substantially does not exceed 200° C.;

(c) pouring a liquid ferro-alloy into the in-gate until the ingot mold is filled, the mass of the copper forming said mold being at least about 6 times the mass of said liquid ferro-alloy;

(d) allowing said liquid ferro-alloy to solidify and cool to a temperature which is about 200° C. to about 300° C. below its solidus point; and (e) immediately separating said mold halves to effect removal of the solidified, cooled ferro-alloy at the temperature of step (c) in the form of ingots.

2. Apparatus for molding ingots of ferro-alloys, said apparatus being adapted for high casting rate and long operating life, comprising:

(a) an ingot mold of high thermal conductivity copper, having a thermal conductivity of at least 400 W/mK, and comprising two mold halves, at least one of said halves comprising a plurality of impressions of ingots to be molded, each impression communicating with its adjacent impression in series, at least one duct for forming said communication, an in-gate opening into said impressions from the upper part of said mold half and an opening from said impression to the atmosphere after the last impression in series, said mold having a mass which is at least about 6 times the mass of the ferro-alloy intended for casting in the mold;

(b) highly efficient means for cooling each mold half by means of a heat exchange fluid, said means being sufficient for maintaining the temperature of said high thermal conductivity copper no more than about 200° C. at all points of the mold;

(c) means for bringing the two mold halves into contact in sealing relationship;

(d) means for moving the two mold halves apart for rapid extraction of molded ingots; and (e) means for guiding the mold halves in their movement away from each other and in their movement for bringing them into sealing relationship.

3. Apparatus according to claim 2 characterised in that the two mould halves (2) comprise symmetrical impressions or cavities (10).

4. Apparatus according to claim 2 characterised in that the two mould halves comprise asymmetric impressions or cavities (10A).

5. Apparatus according to claim 2 characterised in that one at least of the mould halves comprises raised moulding portions (14).

6. Apparatus according to claim 2 characterised in that it further comprises a cooled means (17) for introducing the liquid ferro-alloy into the ingate.

7. Apparatus according to claim 2 characterised in that it is made of electrolytic copper, in accordance with the standard 1SO Cu-EPT, having a thermal conductivity of between 400 and 412 W/mK.

8. Apparatus according to claim 2 characterised in that the cooling means is formed by internal ducts (5) in the mould halves.

9. Apparatus according to claim 2 characterised in that the cooling means is formed by tubes (6) which are welded over their entire length to the external face or faces of the mould halves.

10. Apparatus according to claim 2 wherein the ratio of the mass of copper forming the ingot mould to the mass of ferro-alloy cast is from 10 to 25.

* * * * *